United States Patent [19]

Bubley

[11] Patent Number: 4,924,599

[45] Date of Patent: May 15, 1990

[54] UV CURING APPARATUS

[75] Inventor: Henry J. Bubley, Deerfield, Ill.

[73] Assignee: American Screen Printing Equipment Company, Chicago, Ill.

[21] Appl. No.: 78,916

[22] Filed: Jul. 28, 1987

Related U.S. Application Data

[63] Continuation-in-part of Ser. No. 17,217, Feb. 20, 1987, which is a continuation of Ser. No. 794,940, Nov. 4, 1985, Pat. No. 4,646,446.

[51] Int. Cl.[5] ..... F26B 3/28

[52] U.S. Cl. ..... 34/4; 34/41

[58] Field of Search ..... 34/4, 41; 118/642, 643; 427/54.1, 55

[56] References Cited

U.S. PATENT DOCUMENTS 4,434,562 3/1984 Bubley et al. ..... 34/4

4,485,565 12/1984 Ertl et al. ..... 34/4

*Primary Examiner*—Henry A. Bennet

*Attorney, Agent, or Firm*—Fitch, Even, Tabin & Flannery

[57] ABSTRACT

A UV curing apparatus includes a single UV lamp providing a source of UV energy for irradiating ink on a substrate being conveyed through a UV curing station. Substantial reductions in the amount of energy absorbed by the substrate and substantial increases in conveying speeds may be obtained by use of a reflector means which preheats the ink to raise its temperature and then applies UV to cure the previously heated ink. The preferred reflector means has an upstream preheating section of a parabolic shape for providing IR radiation to preheat the ink and a second downstream section of elliptical shape to provide maximum UV radiation of the previously heated ink.

7 Claims, 3 Drawing Sheets

FIG. 2
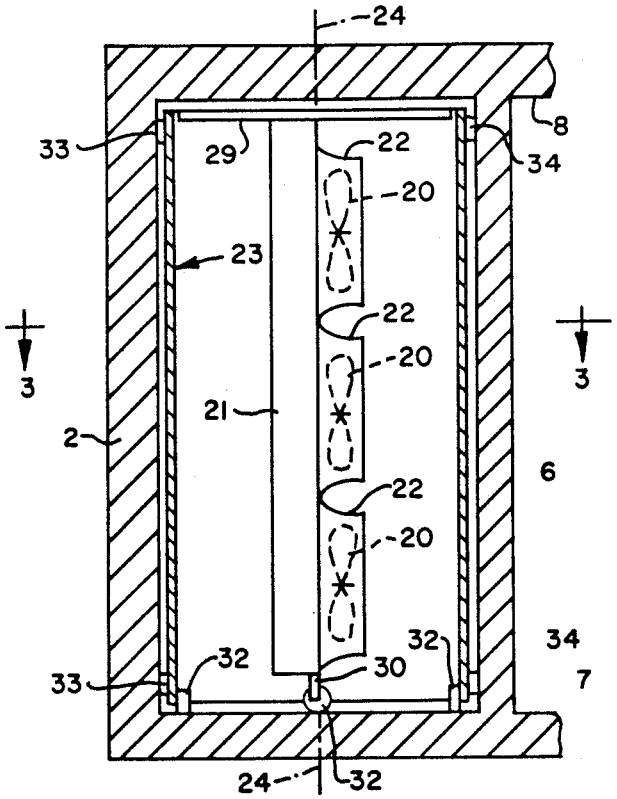
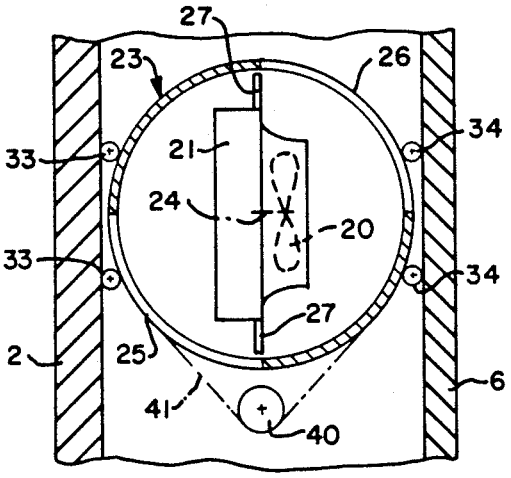
FIG. 3

UV CURING APPARATUS

RELATED APPLICATIONS

This application is a continuation-in-part of U.S. Pat. Application Ser. No. 17,217, filed on Feb. 20 1987, entitled UV Curing Apparatus, an invention of Henry J. Bubley, which is a continuation of U.S. Ser. No. 794,940, filed Nov. 4, 1985, now U.S. Pat. No. 4,646,446.

BACKGROUND OF THE INVENTION

1. Field of the Invention

The invention relates to ultraviolet light curing apparatus for curing ink which has been applied to printed stock by a screen printing apparatus or the like. In particular, the invention relates to ultraviolet curing of screen printer products which reduces heat imparted to the printed stock during curing, while improving the rate at which curing is effected.

2. Description of the Prior Art

Over the years, inks of different chemical types have been proposed for screen-printed products. After analyzing problems associated with different types of ink solvents, problems of space requirements for equipment processing the printed products, and problems of achieving commercially acceptable chemical reaction rates, ultraviolet (hereinafter "UV") inks represent the most viable approach for producing screen-printed materials in a commercial production environment.

One prominent problem associated with UV curing is the heat rise of the printed product inherent in the UV curing operation. In one aspect, heating of the printed stock is inherent in UV curing, since UV lamps which provide the source of UV curing energy require a plasma arc having a typical temperature of 2300° F. Further, in order to sustain the arc within the lamp the outer envelope of the lamp, usually made of quartz glass, must be maintained at 1500° F. It can be readily appreciated, therefore, that one major problem attending UV curing is that the substrate upon which the ink is printed, absorbs heat from the UV radiation source, particularly since the printed stock is close to the UV source to reduce UV losses. Commercial printing operations frequently accumulate printed material in stacks adjacent the printing station, and an excessive temperature rise in the stock is objectionable. The residual heat accumulated from a number of sheets of recently printed stock can be significant, particularly for sheets interior of the stack, where convection cooling is not available. A need therefore exists for cooler methods of UV printing, and several arrangements have been proposed for a forced cooling of the printed stock, to remove residual heat build-up. To date, these methods have proven to be the most effective for reducing the temperatures of printed products.

U.S. Pat. No. 4,434,562 discloses an ultraviolet curing apparatus for curing UV sensitive ink which has been applied to a substrate, such as a sheet of paper, paperboard stock or textile goods by a screen printing apparatus. The ink-bearing sheet is carried on a mesh conveyor through a housing in which is located one or more UV lamps which direct UV light to impinge on the ink on the upper side of the traveling sheet. The sheet is held down on the open mesh conveyor belt by means of a suction applied from a suction blower unit located beneath the belt. The suction applied also draws air through light baffles which are impervious to air. The suction forces hold the sheet flat against the mesh conveyor belt and against fluttering or otherwise flapping from the surface of the conveyor belt. A fan located on top of the housing directs cooling air over the reflector and leading portion of the stock as it exits the curing apparatus.

Another significant improvement in cooling the paper stock as well as the UV lamp is provided in U.S. Pat. No. 4,646,446, which locates a cooling station immediately downstream of the UV curing station. Air knives at the cooling station increase the air velocity, and cause a turbulent flow across the sheet to provide cooling of the sheet. An air-pervious conveyor overlying a suction device secures the sheets against fluttering at both the curing and cooling stations.

Two-stage UV curing has been proposed to provide a pretreatment of the ink before being exposed to a final source of curing radiation. In many arrangements of this type, two UV lamps are provided, one located upstream of the other, to provide a preconditioning of the ink. However, such multi-lamp arrangements are expensive to manufacture and operate, are bulkier than single-lamp units, and tend to produce more heat partly because of the duplication of energy-consuming lamp components. Considerations of space are particularly important for multicolor printing operations wherein substrates are typically loaded onto a movable conveyor apparatus which moves the substrates along a sequence of printing stations, each printing a different color ink onto the substrate. In installations of this type, curing units must be provided at each printing station to cure the ink before advancing the substrate to the next printing station. The weight of the curing stations is also important, as when the curing and printing stations are supported by a common frame.

One example of preconditioning to improve UV curing rates is given in U.S. Pat. No. 3,983,039. An arrangement is provided for reducing oxygen inhibition of intermediate chemical reactions which slow the UV polymerization of the ink. A pre-curing is employed to seal the surface layer of the uncured photosensitive ink film to reduce the effects of oxygen inhibition on the ink's deeper layers. A single lamp is used to effect the pre-curing or surface sealing of the ink at a relatively low energy level, which is achieved in a first or upstream planar reflector portion. A second or downstream reflector portion is curved to provide a peaked relatively high intensity region of UV illumination. The surface sealing of the pre-curing is accomplished with a lower level UV illumination of the ink. However, this approach ignores other mechanisms attendant in the UV curing process, and in general, significant reductions in curing rates are still being sought.

As will be discussed below, other approaches to lowering of the temperature stock by cooling the UV lamp or reflector, or by altering the shape of a given reflector, have been proposed. However, as will be discussed below, a careful review of these approaches during the initial stages of developing the invention has indicated that these approaches are, in general, ineffective to reduce the temperature rise experienced in printed stock using UV curing. Improvements in curing rates for commercial printing operations are still being sought. It is generally desirable from a system operations standpoint, that the curing station not be the limiting factor in high-speed multicolor printing operations, and any reduction in process times, such as the time required to cure light-sensitive ink contributes directly to the profitability of a printing operation.

SUMMARY OF THE INVENTION

Accordingly, it is an object of the present invention to provide a more efficient UV curing system having a single lamp which allows an increase in the rate at which inked stock is moved past the curing lamp and thereby a reduction of heat rise in the stock.

Another object of the present invention is to provide an UV curing unit of the above-described type having a compact size and simple, economical construction.

These and other objects of the present invention, which will become apparent from studying the appended drawings and description, are provided in a UV curing apparatus at a curing station for irradiating ink on a substrate being conveyed past the apparatus. The apparatus is comprised of a single lamp providing a source of UV energy for irradiating the ink. A reflector, surrounding a portion of the UV lamp remote from the substrate, has two reflector portions to direct radiation from the lamp to the substrate. The reflector provides a first preheating region of infrared radiation intensity for raising the temperature of the ink so that the preheated ink will be cured more quickly at a second downstream region of peaked UV radiation intensity where curing of the ink is completed. Thus, the reaction time to cure the UV ink is substantially reduced with the ink having been preheated and this allows faster belt speeds and less exposure of the stock for heat rise.

The present invention, in one of its aspects, provides a reflector for a single lamp, having two dissimilarly-shaped curved reflector portions generally on the upstream and downstream sides of a UV lamp. The upstream reflector portion is generally parabolic and provides more uniform preheat over an initial pretreatment time to raise the ink temperature for a faster reaction, while the downstream reflector portion is generally elliptical and focuses the majority of the UV curing radiation to quickly cure the ink. A much-improved performance is realized with the more efficient transfer of UV energy to the ink, resulting in a significantly reduced curing time and faster conveyor speeds past a lamp of a given power rating. With less time exposed to the UV lamp, there is a substantial reduction in heat absorption and heat rise in the stock.

BRIEF DESCRIPTION OF THE DRAWINGS

In the drawings, wherein like elements are referenced alike,

FIG. 2 is a graph depicting the performance of several types of differently-shaped reflectors for UV curing lamps, including the configuration of a lamp reflector constructed in accordance with one embodiment of the present invention;

FIG. 3 is an elevational cross-sectional view of a lamp apparatus having an elliptical reflector;

FIG. 3A is a graphical representation of the intensity of radiation directed onto a printing substrate by the reflector of FIG. 3;

FIG. 4A is a graphical representation of the intensity of radiation directed onto a printing substrate passing under the reflector of FIG. 4;

FIG. 5A is a graphical representation of the intensity of radiation projected onto a printing substrate by the reflector of FIGS. 1 and 5.

DETAILED DESCRIPTION OF THE PREFERRED EMBODIMENT

Figure 1:
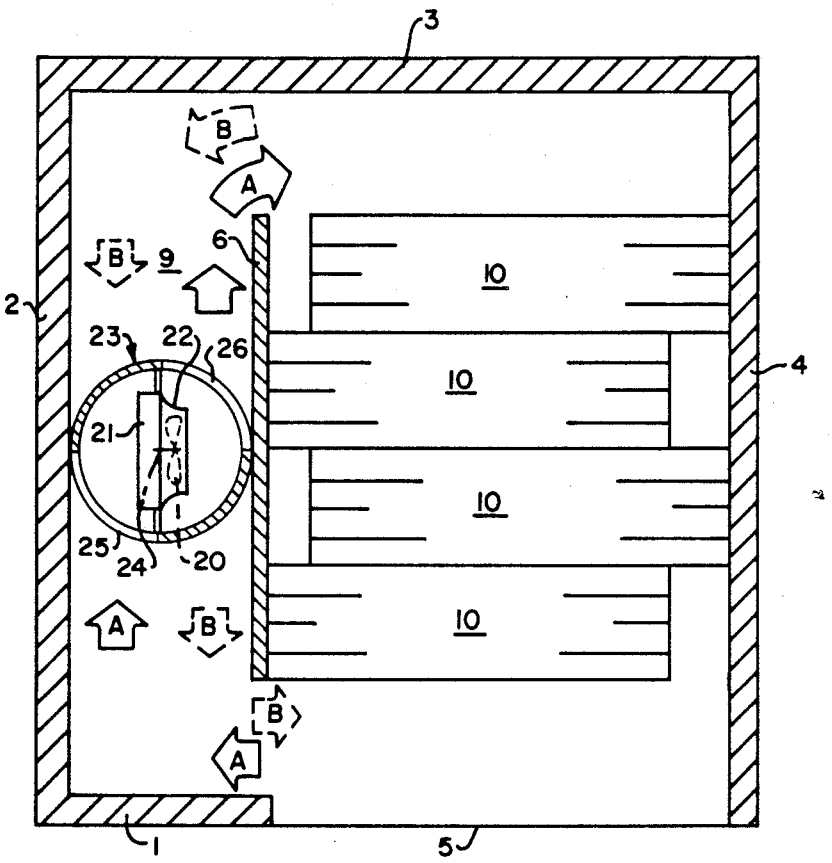
FIG. 1 is an end view of a curing apparatus constructed in accordance with a preferred embodiment of the invention.

As shown in the drawings for purposes of illustration, the invention is embodied in a curing apparatus preferably of the type disclosed in U.S. Parent No. 4,646,446 which is herein incorporated by reference. The apparatus includes a conveying belt 10 which carries a printing substrate or sheet 11 in the direction of arrow 70, for continuous uninterrupted travel through an inlet opening 12 into the interior of a UV curing chamber 14. The curing chamber is covered by an upper housing 15 within which is mounted a single UV lamp 16, which serves as a source of UV energy to be radiated onto ink printed onto or otherwise carried by sheet 11. The UV lamp 16 is partially surrounded by an inverted reflector 20 which opens towards sheet 11. Reflector 20, which is mounted in the housing 15, directs radiation from lamp 16 toward sheet 11, and is constructed according to one aspect of the present invention so as to improve the efficiency of the curing operation. Reflector 20 is provided with a novel configuration which, as will be seen, provides not only an enhanced curing efficiency but also derives a unique bi-modal two-stage energization from a single lamp, without requiring additional lamps, reflectors, or other imaging or lamp assembly components. A blower means 24 located beneath the housing is connected by a duct 22 to one end of the housing, as shown in U.S. Pat. No. 4,646,446 and directs air into the interior of curing chamber 14, as indicated by the arrows. As indicated, air is directed over the surface of reflector 20 to conduct heat away therefrom. A deflector portion, not shown, directs air across the inner surface of reflector 20 to further reduce heat build-up therein, while avoiding contact with a lamp 16, thereby helping to maintain the efficiency of the heat lamp apparatus.

Housing extensions 36 are connected by hinges 38 to the lower edge of upper housing 15, to prevent UV light from escaping the interior of the chamber of upper housing 15. Baffling of the UV light is also provided by overlapping V-shaped elements or chevrons 40 that cooperate to define a continuous surface, preventing reflection of light therethrough, while being spaced apart from each other to accommodate the air flow present within the housing chamber. A plate or element 44 extends from the upstream chevron baffle 40 to define a constricted inlet opening 46 through which the printing substrate 11 is received. Further, a resilient flap-like baffle 48 is provided at the end of downstream chevron-like baffle 40 to present a light-tight exit through which the cured substrate 11 is passed as it travels along conveyor belt 10.

The illustrated curing apparatus has been provided with high velocity air cooling means 50 which delivers a turbulent flow of air across the surface of the sheet to remove heat therefrom in a quick and efficient manner. The preferred air cooling means delivers air in a turbulent state, i.e. flowing with a velocity higher than the Reynolds number across the surface of the sheet 11 to increase the heat transfer and the removal of heat with room temperature air being delivered by the air cooling means 50. The preferred system provides high pressure room air into an air plenum 51 and the air means comprises air knives which convert the large volume of high pressure air into high velocity jets or streams of air having a high velocity, e.g. of 1000 fpm. These high velocity air jets accomplish the cooling of the sheets more quickly and in a smaller space than could be obtained otherwise, particularly from ambient air.

The high velocity cooling air, e.g., air at 1000 fpm, issues from a series of parallel air knives 52*a*; 52*b*; and 52*c* each of which has an elongated discharge slit or nozzle 55 for discharging air streams 56*a*, 56*b* and 56*c* directly against the upper surface of a sheet 11 traveling therebeneath. By way of reference only, the width of the nozzles 55 may be as small as 1/16th of an inch and the air pressure in the plenum is sufficient to produce a very high velocity of air flow is achieved when the air is pulled down through the very narrow slots 55.

The high velocity air streams 56*a*, 56*b* and 56*c* flowing over the top surface of the sheet 11 make an area of reduced pressure at the upper surface 19 and the sheet tends to lift and fly from the conveyor belt 10; but the sheets are held against such flying by the vacuum hold down achieved by a suction means which, in this instance, comprises a suction box 52 and suction blower 54 (FIG. 2) connected to the suction box to pull the sheet down tight against the conveyor belt.

The illustrated and preferred system uses three or four air knives 52 each of which has an upper tapered downwardly narrowing throat section 57 leading downwardly to its associated lower nozzle or slot 55 defined between a pair of parallel sheet metal walls which are spaced 1/16th of an inch apart in this instance. High pressure air in the plenum accelerates and loses pressure as it flows through the throat section 57 and the slots 55 to discharge as jets each with a velocity above the Reynolds number, e.g., 1000 fpm, in this instance. In the illustrated invention, three jets 56*a*, 56*b* and 56*c* strike the sheet at three longitudinally spaced positions as the sheet travels beneath the three nozzles 55 with each of the three jets having turbulent flow, as indicated in FIG. 1, across the transverse surface of the sheet.

The vacuum chamber 52 opposes the upper housing or chamber portion 15 on the remote, underside of conveyor belt 10. The vacuum fan 54 assists the air flow initiated by pressure fan 24 to create a controlled flow pattern within chamber 15 and across the surface of substrate 11, while removing any harmful ozone that is created within the chamber 15. Accordingly, the upper surface 56 of vacuum chamber 52, as well as the conveyor belt 10 passing thereabove, are preferably porous to assist in holding substrate 11 flat against the conveyor belt 10 while the substrate is passing through vacuum chamber 52 and to assist in establishing and maintaining the above-mentioned air flow within chamber 15 and across the surface of substrate 11.

Heretofore, it was thought that the heat rise in an inked substrate was effected by operation of the reflector as a secondary source of radiation. A mathematical analysis based on the Stefan Boltzmann Law during development of the present invention clearly showed that radiation from the UV lamp was at least 1300 times more effective than the radiation from the reflector and consequently, attention was focused on other aspects of lamp reflector operation.

The following is a brief discussion of the faster curing performance at lower temperatures, of a curing apparatus according to the present invention, compared to conventional reflectors having parabolic and elliptical shapes. By way of background, as was pointed out above, screen printing operations which use UV inks, such as those of the photopolymerizable-type, require an additional curing station downstream of the printing station where the ink printed on the substrate is radiated with UV light for a time sufficient to cause curing thereof. Faster production rates are, in general, desired, but less curing energy is imparted to the ink if the feed rate of the substrate is increased without an increase in the intensity of the UV source. A simple increase in the power output of a UV source is unsatisfactory since greater amounts of energy are also directed onto the substrate carrying the ink, leading to a build-up of residual heat when the substrates are subsequently stacked, rolled or otherwise stored awaiting a further, post-printing operation. It has also been found that if lower wattage UV lamps are used with slower feed rates, undesirably large amounts of heat are also imparted to the substrate, rather than the ink.

A considerable amount of work has already been done in an attempt to find a cooler UV curing method. Other than forced air cooling, none of the proposed techniques have resulted in a significant reduction in heat rise, and have otherwise failed to effect a difference in the heat absorption characteristics of inked substrates which have been cured using UV techniques. While some have argued that changing the reflector shape would lower the heat rise in the inked substrates, tests conducted during development of the present invention have indicated that such does not appear to be the case. Rather, the basic formula for determining heat rise, which will be set forth below, applies equally to all reflective shapes and is insensitive to the particular reflector configuration. Rather, the heat rise is a function of the lamp energy, the belt speed or exposure, and whatever subsequent cooling might be applied downstream after radiation of the inked substrate.

Others have argued that water cooling of the reflector or the lamp itself would result in a lower temperature rise in the inked substrate being cured. Again, during development of the present invention, tests conducted on these types of curing systems have indicated that there is no perceptible effect on the substrate temperatures and, as predicted by theory used to develop the present invention, no temperature reduction was observed.

Use of reflector materials which absorb infrared energy and jacketing of the UV lamp with IR energy-absorbing materials such as water, have also been proposed. Test results during development of the present invention directed to these techniques indicate that while these arrangements filtered IR energy to some extent, they also reduced the UV energy incident on the inked substrate, thereby resulting in a much slower curing rate requiring prolonged exposure times which increase the IR exposure beyond previous levels experienced by other unfiltered radiation sources.

Rather than take these previous approaches, development of the present invention focused on the direct effect of heat rise due to IR energy absorption of an inked substrate from the UV curing lamp to which the substrate was unavoidably exposed. By recognizing and accounting for the effects of both UV and IR energy, a balance was achieved which reduces the total amount of energy required for the total curing of an inked substrate, thereby providing a faster curing condition which significantly lessened not only exposure to IR energy, but also reduced the energy requirements for UV curing radiation.

By observing the chemical reaction of UV-sensitive inks, it has been observed that improvements in reaction times can result from raising the temperature of the ink prior to the UV radiation-induced reactions. Realizing that with proper preheating of an ink prior to its exposure to UV energy, the amount of energy can be significantly reduced, thereby indicating a faster belt speed in a commercial production environment. A number of tests were conducted to quantify the effect of preheating on a number of different types of reflectors. Four reflector types were examined, one of which includes the reflector shape according to a preferred embodiment of the present invention. The other three shapes include an elliptical reflector, a parabolic reflector closely spaced to the inked substrate, and the same parabolic reflector raised 2 inches further away from the ink substrate. As will be seen, all of the tests pointed to significant improvements, up to 400%. Further development of reflector designs resulted in the configuration illustrated in FIGS. 1 and 5 which provides a bimodal function operating in both the infrared and ultraviolet spectra. The first tests to be described herein are directed to a parabolic reflector surface having an aperture of 7 inches.

The following relationship is used to determine heat rise in screen printed products:

$$Q=WC(\Delta T)$$

where Q represents the heat energy (watt-seconds) imparted to the substrate and ink, in BTUs, W is the weight of the substrate, C is the specific heat and reflective characteristics of the substrate, and $\Delta T$ is the consequential temperature rise of the substrate. This theoretical relationship was empirically validated for reflectors of different shapes in common use today. It was found that reflector shape did not have an observable effect on heat rise. Rather, it was found that the heat rise, Q, was a direct consequence of the energy absorption from the lamp. As predicted by theory, and validated by empirical testing, all reflectors, no matter of what shape, generate the same heat rise. Rather, the heat rise of a substrate depends solely upon the exposure of that substrate to the energy of the lamp radiation source. A more detailed analyses of four different reflector configurations, one of which includes the reflector shape according to some aspects of the present invention, are given below.

Figure 4:
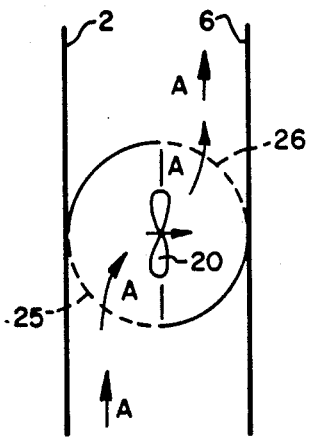
FIG. 4 is a cross-sectional view of a UV curing apparatus having a generally parabolic shape.

The empirically observed performance of reflectors having a parabolic shape, such as the reflector of FIG. 4, is plotted along curve 100 of FIG. 2 for 300 watt and 200 watt lamps, respectively. As can be seen, this corresponds closely with predicted theory, which is illustrated by curve 102 of the same Figure. The empirical analysis was repeated with the same parabolic reflector, but with the reflector raised two inches further away from the radiation-receiving surface of the ink-carrying substrate. The results are indicated by the curves 104 in FIG. 2. The reflector 20 of this invention produced curves 120.

Turning now to elliptical reflectors, the theoretical and empirically-observed performance curves 110 and 112 of FIG. 2 for the elliptical reflector of FIG. 3 agree quite closely. In general, the elliptical reflector provides a greater focusing of the UV energy into a confined space through a smaller aperture. Accordingly, for a given lamp size, the same available UV energy is directed through a smaller aperture. If the exposure time is reduced proportionally by increasing the belt speed, it is seen that the sharper focus of the elliptical reflector results in a lower exposure time. Since heat rise, as seen above, is proportional to the wattage of the energy source and the exposure time of the substrate to that source, the shorter the exposure time, the lower the heat rise experienced by the substrate. Accordingly, the heat rise in the substrate is expected to be approximately the same, for a given size lamp, for reflectors having both parabolic and elliptical shapes. As indicated in FIG. 2, this has been empirically confirmed.

Figure 5:
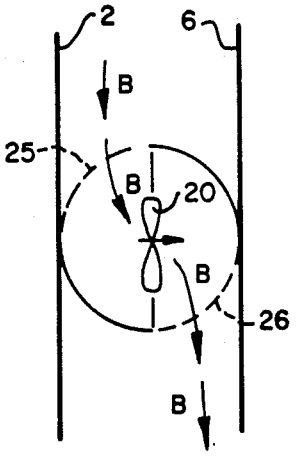
FIG. 5 is an elevational cross-sectional view of the reflector and UV curing lamp of FIG. 1.

Having thus attained a reasonably good correlation between empirically derived performance data and theoretically predicted results, comparison tests were conducted using the reflector shape according to one embodiment of the present invention, as illustrated in FIGS. 1 and 5. These tests were performed to quantify the improvement in performance afforded by reflectors constructed according to principles of the present invention, compared to elliptical reflectors and parabolic reflectors placed both as close to the substrate surface as practicable, and raised 2 inches thereabove. These tests will be described later.

The shape of the reflector 20 shown in FIGS. 1 and 5, when viewed in cross-section, is not symmetric about the central point 60, positioned generally along the vertical axis of lamp 16. Rather, the first, upstream portion 64 is less sharply curved while the second, downstream portion 66 has a considerably steeper or sharper curve. Both upstream and downstream portions are, however, generally curved and both are non-planar. Expressed in another way, the upstream reflector portion 64 has a larger aperture measured from the vertical axis of lamp 16 to the upstream end 65 of the reflector. The more sharply curved, downstream portion 66 has a correspondingly smaller aperture as measured between the vertical axis of lamp 16 and the downstream end 67 of reflector 20. As shown in the illustrated reflector of FIG. 1, the aperture for the upstream reflector portion 64 is three times as large as the aperture for downstream portion 66. In a substantially similar reflector illustrated in FIG. 5, the upstream portion has an aperture twice as large as the downstream reflector portion. According to one aspect of the present invention, the ratio of upstream to downstream aperture lengths ranges between 1.5 and 4, and preferably ranges between 2.5 and 3.5.

According to another aspect of the present invention, the larger upstream portion 64 is characterized by a generally paraboloid cross-sectional shape, whereas the downstream reflector portion 66 is characterized by a generally ellipsoid shape. As explained above, UV curing lamps produce considerable amounts of heat (and therefore infrared [hereinafter "IR"] energy) because of their internal plasma operating elements. Consequently, the substrate passing under reflector 20 receives both IR and UV energy which, according to aspects of the present invention, are both "focused" or otherwise developed in a well-defined manner to optimize the curing rate of the UV-sensitive ink. Even though the ink is not photosensitive to IR radiation, the curing rate of UV sensitive ink is directly related to the temperature of the ink prior to its exposure to a source of UV radiation. The present invention optimizes the coincident radiation of both IR and UV spectra in a unique manner to optimally heat the ink prior to its exposure to significant quantities of UV energy in a way which reduces the required total exposure time of the ink, and therefore can be used to reduce the exposure times of substrates carrying the ink, to both types of energy, UV and IR.

These two preferred reflector shapes, paraboloid and ellipsoid, as will be pointed out in greater detail below with reference to FIG. 5A, provide a uniform IR preheating portion upstream of lamp 16 followed by a UV curing adjacent and downstream of the lamp. Accordingly, the present invention provides IR radiation via an upstream reflector portion 64 to furnish an IR preheat to the UV ink carried by substrate 11 during the time the substrate travels under the first, upstream reflector portion 64. The ink receives some UV energy at this stage, however, the quantity of UV energy received is relatively minor compared to the downstream portion. Thereafter, as the substrate passes directly underneath the lamp 16 and then under the downstream or sharply curved reflector portion 66, the radiation from lamp 16 completes the curing process of the preheated ink. A further explanation of these features will be given with reference to FIGS. 3–5 and the corresponding intensity curves of FIGS. 3A–5A.

Referring now to FIG. 3, a reflector 80 is illustrated having a generally elliptical cross-section. The curve 82 of FIG. 3A shows the intensity of both UV and IR radiation present at different points along the reflector aperture. As can be seen, curve 82 has a sharply rising peak, characteristic of elliptical reflectors. The parabolic reflector 84, illustrated in FIG. 4, has a slightly larger aperture (7 inches, as opposed to 5 ½inches for reflector 80). An intensity curve 86, (see FIG. 4A.) shows a graph of IR and UV radiation intensity at the aperture of parabolic reflector 84, and indicates that the radiated intensity is generally constant throughout the greater portion of the aperture. Further, the curves of FIGS. 3A and 4A are drawn approximately to the same scale, with the relatively constant intensity output of the parabolic reflector 84 having a magnitude approximately equal to the peak of the intensity curve 82 for the elliptical reflector 80.

The novel reflector 20 of FIG. 5 has a cross-sectional shape similar to that illustrated in FIG. 1, except that FIG. 5 has a slightly more abrupt or steeper downstream portion, with 16 spaced slightly lower and upstream of the position shown in FIG. 1. These varied configurations of reflector 20 are quite close and each exhibits the same important aspects of the present invention, as is now explained. The upstream reflector portion 64 is, according to one aspect of the present invention, characterized by a generally paraboloid cross-sectional curved configuration, whereas the downstream, more sharply curved reflector portion 66 is characterized by a generally ellipsoid configuration in cross-section. FIG. 5A shows an IR intensity curve 90, which plots the infrared radiation intensity experienced by a substrate at the aperture of reflector 20, and is drawn according to the same approximate scale as FIGS. 3A and 4A for the preceding elliptical and parabolic reflectors, respectively. The IR intensity curve 90 has a first portion 92 which indicates the intensity of the infrared spectrum of the energy incident on the ink being cured. Curve 90 rises quickly to a peak and gradually tapers off to a medial, relatively short plateau region. Following the plateau region is a more constant trailing portion 96, which is not of particular significance to the UV curing process, since, in general, temperature rise prior to exposure to UV radiation is significant in enhancing the chemical reaction of the ink. The significance of curve 90 is the early occurring infrared peak upstream of the point 60 of the reflector, indicating that the ink is preheated by IR energy prior to its exposure to the major portion of the UV energy focused by reflector 20 onto the substrate. The UV energy has an intensity curve (not shown in the Figures) which peaks at a point downstream of the infrared peak of 90 shown in FIG. 5A. The distance between peaks is approximately equal to four lamp diameters and can range between two and six diameters. Taking into account the bi-modal or dual spectrum operation of reflector 20, the ink experiences an upstream infrared exposure followed by a downstream UV peak. According to some features of the present invention, the differences in the way IR and UV energies are absorbed by a UV-photosensitive ink is employed to minimize the exposure time. For example, the IR absorption process spreads rapidly through the depth of the exposed ink film, whereas the UV process is quite different, being more "path dependent". It is possible that not all of the UV energy incident on the ink film reaches UV photo initiators at the deeper layers of the thicker films. By effectively causing a preheating of the ink film to occur, the excitation of the molecules within the ink film due to elevated temperatures allow deeper and faster penetration of the UF energy. This unique bi-modal, curing provides heretofore unattainable increases in curing efficiency, up to 400%, using a single. This, in turn, leads directly to a corresponding increase in the feed rates of the printed substrates processed by the curing apparatus.

The 400% increase in curing efficiency will be described in connection with the following table which lists belt speeds at which curing of UV-sensitive ink is observed under varying conditions as indicated. The ink tested was catalog number, EXL 700 (Black) available from Advance Process Supply Company of Chicago, Ill.

BELT SPEEDS (FPM) AT WHICH CURING IS ATTAINED

| UV Lamp Bulb Rating | Elliptical w/o Preheat | Elliptical With Preheat | Parabolic w/o Preheat | Parabolic With Preheat |
|---|---|---|---|---|
| 300 W | 35 (800U) | 60 (424U) | 90 (306U) | 100 (278U) |
| 200 W | 25 (800U) | 40 (454U) | 45 (510U) | 60 (321U) |
| 150 W | 15 (800U) | 30 (450U) | 30 (786U) | 45 (340U) |
| 100 W | — | — | — | 15 (—) |

| UV Lamp Bulb Rating | Parabolic Raised 2 Inches w/o Preheat | Parabolic Raised 2 Inches With Preheat | Invention |
|---|---|---|---|
| 300 W | 80 (354U) | 90 (300U) | 150 (200U) |
| 200 W | *** | 40 (481U) | 70 (187U) |
| 150 W | 15 (—) | 25 (625U) | 50 (210U) |
| 100 W | — | 15 (—) | 35 (—) |

***30 FPM (est.). . . see text

The numbers in parentheses, where noted, indicate the units of relative amounts of energy absorbed by the substrate passing through the UV curing apparatus. The energy units were measured with a commercially available radiometer sensitive to UV wave lengths. The units measured have dimensions of microjoules per square centimeter and are designated "U" in the above table. Missing and unattainable data is indicated by dashes. In general, the 100W UV lamp was not able to cure printing on inked substrates carried at a commercially practical belt speeds. The numbers before the parentheses represent the maximum conveyor speed at which the substrates could be conveyed through the curing station and still have sufficient time for curing of the ink on the substrate. At faster speeds than those indicated, the ink did not fully cure. The speeds are in feet per minute.

The very significant decreases in the amount of energy absorbed by the substrate when using a "preheat" of IR heaters prior to the elliptical reflector 80 and the UV lamp 16 (or the parabolic reflector 84 and the UV lamp 16) or when using the reflector 20 shown in FIG. 5 having a parabolic section 64 for preheat and a downstream elliptical reflector section for focused peak. UV radiation is readily apparent from the tables. For instance, the elliptical reflector 80 without a preheat caused the substrate to absorb 800 units before curing versus only 187 units for the present "invention", which means the reflector 20 shown in FIG. 5. This 400% difference in heat absorption is primarily a function of belt speed since the belt could be run at a maximum speed of 25 fpm with curing being obtained when using a 200 watt bulb whereas curing was obtained at a belt speed of 70 fpm when using the 200 watt bulb and a reflector having the parabolic preheat section 64 and the elliptical UV peak focus section 60, as shown in FIGS. 1 and 5. When using IR heaters (not shown) immediately prior to the elliptical reflector 80 or the parabolic reflector 84, the 200 watt bulb 16 cured ink with a substrate absorption of 454 units which is substantially less than the 800 units for the same reflector without the preheat; and the speed was 40 fpm versus 25 fpm. As shown in the table, less heat absorption is primarily a function of faster cure of the ink and therefore faster belt speeds being obtainable, e.g. a 40 fpm belt speed when using a preheat versus 25 fpm without the preheat and a 70 fpm when using the preheat reflector 20, as shown in the tables. From the tables, it will be seen that with the "invention" reflector 20 that a maximum of 200 units was absorbed by the substrate when using a 300 watt bulb versus 800 units for the elliptical reflector.

Comparing the results for a 200 watt UV bulb, the respective highest belt speeds at which curing was obtained for elliptical and parabolic reflectors without a preheat are 25 and 45 feet per minute, respectively. The maximum belt speed at which curing was obtained using a parabolic reflector raised 2 inches further away from the substrate surface is apparently erroneous, but is estimated to be approximately 30 feet per minute, based on a correlation between readings for 300 and 150 watt UV bulbs, with and without preheat. As shown in the table, curing was attained when using the inventive reflector 20 and a 200 watt bulb at web speeds of 70 feet per minute, which is substantially faster than the maximum 25 fpm curing speed when using an elliptical reflector 80 and which is substantially faster than the 45 fpm curing speed when using the parabolic reflector 84. The faster curing speed of 75 fpm is very significant in reducing the heat rise in the substrate since the heat rise is mainly a function of exposure time when using the same 200 watt UV bulb.

In the "With Preheat" tests recorded in the columns so labeled in the above tables, separate non-bulb IR heaters were positioned before the elliptical reflector 80 to raise the temperature of the ink prior to maximum exposure to the UV light from the elliptical reflector of FIG. 3 and the speed for curing could be raised to 40 fpm rather than 25 fpm for a 200 watt bulb and elliptical reflector 80, as shown in the table. The use of the inventive reflector 20 (FIG. 5) to do the preheating produced even better results with curing being obtainable at 70 fpm with the parabolic section 64 of the reflector doing the preheating. This result is shown under the column heading "invention".

Thus, the present invention provides a surprising improvement over the elliptical, parabolic and raised parabolic reflectors. The curing apparatus constructed according to the present invention provides nearly a threefold increase in performance over the elliptical reflector, and a 56% improvement over the raised parabolic reflector. Even greater improvements over the parabolic reflector are noted for 300 watt and 150 watt bulbs. The improvements are 88% and 67%, respectively, for these wattage ratings. Compared to elliptical reflectors, and parabolic reflectors raised 2 inches further away from the substrate surface, there is an approximate threefold improvement for 300 watt and 150 watt bulbs.

The measured energy density "U" as noted by the values shown in parentheses in the tables, indicates energy density radiated onto the substrate surface. For example, for a 200 watt UV lamp, 800 and 510 microjoules per square centimeter were recorded for an elliptical and parabolic reflectors, whereas only 187 microjoules per square centimeter were recorded for the inventive curing apparatus.

In general, belt speeds attainable with IR preheat offer a modest improvement for elliptical, parabolic and raised parabolic reflectors, but the improvement is far less than that available with the inventive reflector 20 and single-lamp curing apparatus of this invention. For example, for a 200 watt bulb, an elliptical reflector with preheat allows a belt speed of only 40 feet per minute, whereas the single 200 watt bulb apparatus of the invention cures with a belt speed as high as 70 feet per minute, as noted above. The parabolic and raised parabolic reflectors provide a somewhat lesser improvement with cures attained at speeds of 60 and 40 feet per minute, respectively.

As was noted above with respect to test data taken without preheat, a substantially greater gap in performance is observed for 300 watt and 150 watt bulbs. For example, for 300 watt bulbs, the curing apparatus of the invention provides improvements of 250%, 50%, and 67%, over elliptical, parabolic, and raised parabolic reflectors, respectively. For the 150 watt bulb, the curing apparatus of the present invention provides improvements of 67%, 11% and 100%, over elliptical, parabolic, and raised parabolic reflectors, respectively.

Thus, it can readily be seen that the UV curing apparatus, when constructed according to the principles of the present invention, provides a dramatic increase in performance, up to 400%, even significantly greater than that available with less favorable, more costly two-lamp units and other IR devices otherwise providing a preheat.

It will thus be seen that the objects hereinbefore set forth may readily and efficiently be attained and, since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A UV curing apparatus at a curing station for irradiating ink on a substrate being conveyed through the apparatus at an increased speed to reduce the amount of energy absorption by the substrate, said apparatus comprising:

UV lamp means at the UV curing station comprising a single lamp providing a source of UV energy for irradiating the ink;

conveyor means to convey the substrate to and from the UV curing station; and reflector means surrounding a portion of said UV lamp remote from said substrate for reflecting radiation from said lamp means onto ink and onto said substrate, a first preheat section on said reflector means providing a first preheating region of IR radiation for raising substantially the temperature of the ink, a second downstream section on said reflector means for providing an intense UV radiation of the previously heated ink to cure the same more quickly and thus reducing the heat absorption by the substrate being conveyed, the preheat section of the reflector means and the second downstream section of the reflector means comprising first and second curved reflector portions opening towards said substrate, said first preheat section of said reflector means being substantially longer than the second focused section, said second section focusing the UV radiation to cure the heated ink.

2. A method of decreasing the exposure time of a substrate bearing UV curable ink and thereby the amount of energy absorbed by the substrate during the curing of the ink, said method comprising the steps of:

providing a single UV lamp at an ultraviolet light curing station for irradiating the ink and substrate with IR and UV radiation, conveying the substrates bearing ink onto the UV curing station, and directing the lamp radiation to a reflector means which has a first curved section directing radiation in a manner favoring the IR absorption by the ink to preheat the same and which has a second downstream curved section more sharply curved than said first section to focus the UV radiation more sharply than at said first section and directing radiation in a manner favoring UV absorption by the preheated ink.

3. A UV curing apparatus at a curing station for irradiating ink on a substrate being conveyed through the apparatus at an increase speed to reduce the amount of energy absorption by the substrate, said apparatus comprising:

UV lamp means at the UV curing station comprising a single lamp providing a source of UV energy for irradiating the ink;

conveyor means to convey the substrate to and from the UV curing station;

curved reflector means to reflect IR radiation from the UV lamp means to preheat the ink on the substrate thereof to accelerate a later curing thereof, and curved reflector means more sharply curved than said first section to focus the UV radiation and surrounding a portion of said UV lamp remote from said substrate for reflecting radiation from said lamp means onto ink and onto said substrate to provide an intense more focused UV radiation of the previously heated ink to cure the same more quickly and to reduce the heat absorption by the substrate being conveyed.

4. The UV curing apparatus of claim 1 wherein said second, downstream reflector section is substantially elliptical and said first, upstream reflector section is substantially parabolic in shape.

5. The UV curing apparatus of claim 1 wherein said first preheating section extends over a portion of said substrate at least approximately twice as long as said second section.

6. The UV curing apparatus of claim 1 further comprising means for conveying a substrate past said reflector means at a substantially constant feed rate.

7. A method in accordance with claim 2 including the step of directing the substantial IR radiation from a first reflector section for the UV lamp and directing the maximum UV radiation from a second differently curved reflector section for the lamp.

* * * * *